United States Patent [19]

Paladino et al.

[11] 3,977,918

[45] Aug. 31, 1976

[54] METHOD OF MAKING MAGNETS

[75] Inventors: Albert E. Paladino, Needham; Paul F. Weihrauch, Newton Center, both of Mass.

[73] Assignee: Raytheon Company, Lexington, Mass.

[22] Filed: Apr. 7, 1975

[21] Appl. No.: 565,972

[52] U.S. Cl. ..... 148/31.57; 148/103; 148/105; 148/108; 264/65

[51] Int. Cl.[2] ..... H01F 1/04

[58] Field of Search ..... 148/103, 105, 108, 31.57; 264/65, DIG. 58

[56] References Cited

UNITED STATES PATENTS

| | | | |
|---|---|---|---|
| 3,540,945 | 11/1970 | Strnat et al. | 148/31.57 |
| 3,684,593 | 8/1972 | Benz et al. | 148/103 |
| 3,695,945 | 10/1972 | Benz | 148/103 |
| 3,821,034 | 6/1974 | Westendorp et al. | 148/31.57 |

*Primary Examiner*—Walter R. Satterfield
*Attorney, Agent, or Firm*—John T. Meaney; Joseph D. Pannone; Harold A. Murphy

[57] ABSTRACT

A method of making an integral toroidal magnet comprising the steps of compacting suitable magnetic powder material into a toroidal shape while subjecting it to a particle aligning magnetic field, hot pressing the compacted powder toroid in a confining die at a temperature and pressure sufficient to cause shrinkage of the toroid in the axial direction and provide a packing density greater than 93% of the theoretical maximum value and substantially unidimensional shrinkage, heat treating the toroid at a temperature sufficiently higher than the hot pressing temperature to achieve an enhanced crystallographic alignment equivalent to the alignment obtained by sintering, annealing the toroid at a temperature sufficiently lower than the heat treating temperature to provide a magnetic coercivity similar to the coercivity achieved by annealing after sintering, and magnetizing the heat treated toroid in the direction of crystallographic alignment.

5 Claims, 9 Drawing Figures

| ISTROPIC | DENSITY | $B_R$ | $H_C$ | $H_{Ci}$ | BH (MAX.) |
|---|---|---|---|---|---|
| HOT PRESSED | 98.5 | 5300 | 4750 | 18,000 | $6.5 \times 10^6$ |
| COMPACTED SINTERED AND ANNEALED | 93.0 | 4900 | 4400 | 18,000 | $5.5 \times 10^6$ |

FIG. 3
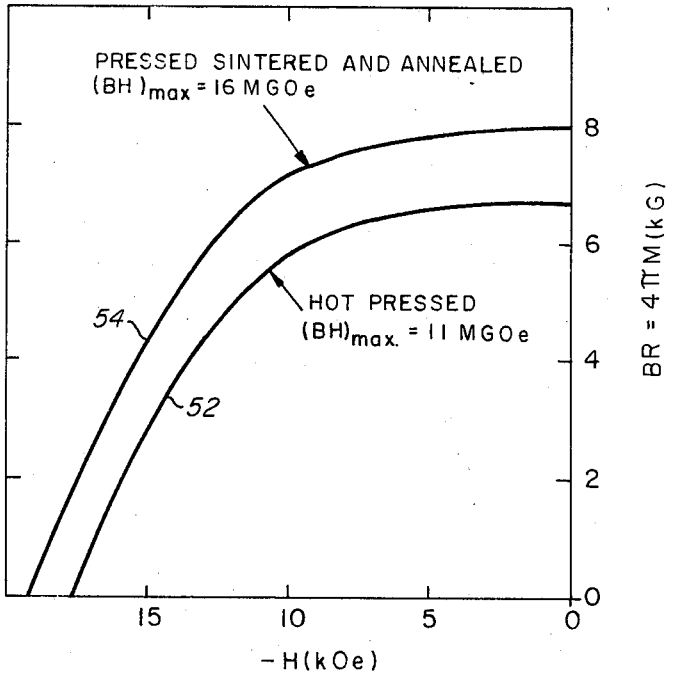
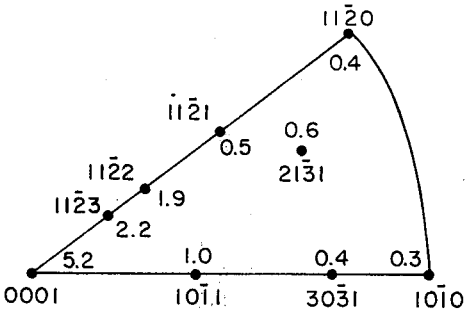
FIG. 4b
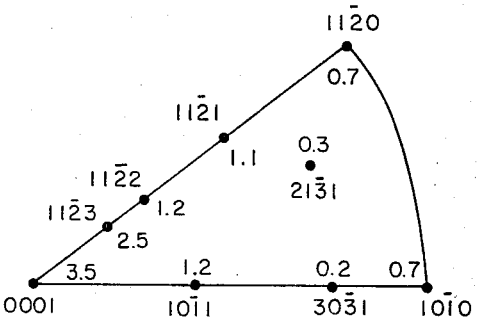
FIG. 4a
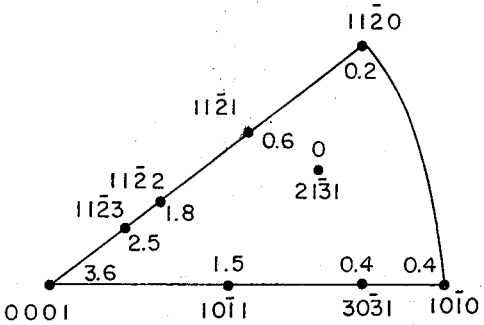
FIG. 4c

METHOD OF MAKING MAGNETS

BACKGROUND OF THE INVENTION

This invention relates generally to permanent magnets and is concerned more particularly with a method of making toroidal magnetic devices from magnetic powder material.

In powder metallurgical fabrication of magnets, such as rare earth-cobalt magnets, for example, the powder usually is aligned and compacted at room temperature to form a magnetic device having a desired configuration. After compacting, the packing density of the powder material may be about 75 percent of the theoretical maximum value, as determined by dividing the weight per unit volume by the density of the material. Subsequently, when the device is heated in an inert atmosphere at a sintering temperature associated with the material, further densification and three-dimensional shrinkage takes place. This densification and shrinkage generally is accompanied by a diffusion bonding of the powder particles to one another and a significant improvement in the magnetic properties of the device.

It is well-known that greater densification of the powder material is achieved at increasingly higher sintering temperatures and, generally, enhances the magnetic properties of the device. However, if the sintering temperature is too high, excessive grain growth occurs and leads to a dramatic loss in magnetic coercivity. Therefore, a sintering temperature is selected which will provide adequate densification of the powder material while minimizing the possibility of excessive grain growth occurring during the sintering operation.

The sintering method is used extensively for fabricating permanent magnets from powder material and has become the accepted method for producing rare earth-cobalt magnets. Therefore, it would seem that the sintering method is ideally suited for fabricating radially aligned toroidal magnets which have a wide applicability in gyroscopes, bearings, microwave tubes, and motors, for examples. The conventional method of producing these toroidal magnets involves a time consuming and costly procedure of assembling radially polarized, arcuate segments into a supporting ring structure. However, efforts to fabricate integral toroidal magnets by means of sintering powder material have not been successful.

It has been found generally that a sintered toroidal magnet made of radially aligned powder particles will develop radial cracks either during the sintering operation or during the subsequent annealing operation. The radial cracks may be due to stresses developed by nonuniform three-dimensional shrinkage of the compacted powder material during the sintering operation, or may be due to thermal expansion differences in the radial and circumferential directions of the toroid. A calculation of the latter effect for a sample heated at the sintering temperature yields an estimated strain of one percent, which is quite high for the usually brittle sintered material to withstand.

Therefore, it is advantageous and desirable to provide a method of fabricating radially aligned toroidal magnets in an efficient and reliable manner which overcomes the disadvantages of the sintering and other prior art methods.

SUMMARY OF THE INVENTION

Accordingly, this invention provides a method of making integral toroidal magnets from magnetic powder material and includes the steps of compacting magnetically aligned fine powder particles, preferably having an average size of about 10 microns, into the configuration of the desired toroidal device, hot pressing the device in a confining die at a pressure and temperature sufficient to produce a packing density at least 93 percent of the theoretical maximum value and substantially unidimensional shrinkage in the direction of applied pressure, heat treating the device at a relatively higher temperature with respect to the hot pressing temperature to achieve a crystallographic alignment generally obtained by sintering the material, annealing at a relatively lower temperature with respect to the heat treating temperature to achieve a magnetic coercivity similar to the coercivity generally provided by sintering the material, cooling to room temperature in a controlled manner such that high magnetic properties are maintained, and magnetizing in the direction of crystallographic alignment. It has been found that by using hot pressing a packing density of 95 percent or better is readily achieved and, consequently, the device will not crack during the subsequent heat treating operation, even when carried out at temperatures higher than the sintering temperature range associated with the powder material. However, it is preferred that the heat treating operation be carried out close to or in the sintering temperature range in order to obtain an equivalent crystallographic alignment while avoiding excessive grain growth. Thus, this inventive method produces an integral toroidal magnet made from powder material having a packing density and an energy product equal to or better than a sintered magnetic device made from the same material.

BRIEF DESCRIPTION OF THE DRAWINGS

For a better understanding of this invention, reference is made in the following more detailed description to the accompanying drawings wherein:

FIG. 3 is a graph showing respective curves obtained from a sintered disc and a hot pressed disc of axially aligned material;

FIGS. 4*a*–4*c* are schematic views of inverse pole figures obtained by X-ray diffraction;

DESCRIPTION OF THE PREFERRED EMBODIMENT

This inventive method is used for fabricating toroidal magnets from fine powder material, such as disclosed, for example, in copending patent application Ser. No.

416,700 filed by Dilip K. Das on Nov. 16, 1971 and entitled "Samarium-Cobalt Magnet", the same being assigned to the assignee of this invention. In the referenced copending application, Das describes a novel magnetic powder material made of samarium and cobalt, the samarium component costituting 36.5–38% by weight of the material and consisting of about 60 parts $SmCo_5$ in proportion to about 40 parts $Sm_2Co_7$. Das also teaches a method of sintering samarium-cobalt material including the preliminary steps of mixing the samarium and cobalt components in the specified percentage range by melting and blending suitable raw materials in an inert atmosphere to obtain a homogeneous mixture, cooling the molten mixture to room temperature in any convenient cast form, and comminuting the cast mixture to produce fine powder particles which, preferably, have an average size of about 10 microns.

Fine powder particles of the samarium-cobalt material, thus produced, may be compacted into a toroidal configuration by a conventional cold pressing technique. A suitable apparatus and method for performing the cold pressing operation is disclosed in a copending patent application Ser. No. 468,606 filed by William R. Reid and Albert A. Gale on May 9, 1974 and entitled "Toroidal Magnetic Device", the same being assigned to the assignee of this invention. The cold pressing apparatus disclosed therein is provided with an electromagnet for producing a particle aligning magnetic field when desired.

Figure 6:
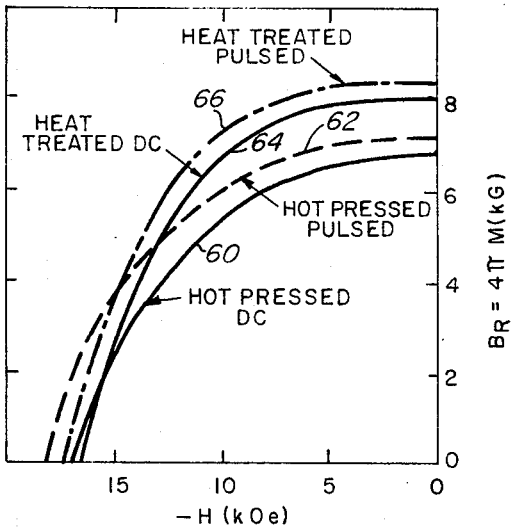
FIG. 6 is a graph showing the effect of using pulsing while compacting magnetic aligned material and the effect of subsequent heat treatment.

With well-known minor modifications, the cold pressing apparatus shown and described in the referenced Reid et al. patent application also may be used for compacting the fine powder, samarium-cobalt material into discs. Also, by providing the cold pressing apparatus with an electromagnet having respective coils located coaxially above and below the compacted powder device, as shown in FIG. 6 of the Reid et al. patent application, for example, the fine powder particles of the compacted device may be aligned radially or axially as desired. When the respective coils of the electromagnet are energized to provide "bucking" magnetic fields, as shown in the referenced FIG. 6, for example, the fine powder particles of the compacted device will be aligned radially with respect to the axial centerline thereof. On the other hand, when the respective coils of the electromagnet are energized to provide "additive" magnetic fields, as in a solenoid, for example, the fine powder particles of the compacted device will be aligned axially. Accordingly, the radially aligned particles are disposed substantially perpendicular to the direction of the applied compacting pressure, whereas the axially aligned particles are disposed substantially parallel therewith.

Thus, the samarium-cobalt powder material disclosed in the referenced Das patent application, and apparatus shown in the referenced Reid et al patent application may be used to produce disc and toroid devices for illustrating the advantages of this inventive method. Accordingly, three types of devices were produced, namely (1) isotropic discs made of compacted unaligned particles of the powder material, (2) axially aligned discs made of compacted axially aligned particles of the powder material, and (3) radially aligned toroids made of compacted radially aligned particles of the powder material. Samples of the isotropic discs and the axially aligned discs were sintered at a temperature, such as 1120°C, for example, in the sintering temperature range disclosed by Das in his referenced copending patent application. Subsequently, the sintered discs were annealed at 900°C for about 2 hours in an inert atmosphere, such as helium, for example. After cooling to room temperature, the annealed discs were magnetized in the axial direction.

Figures 1, 2:
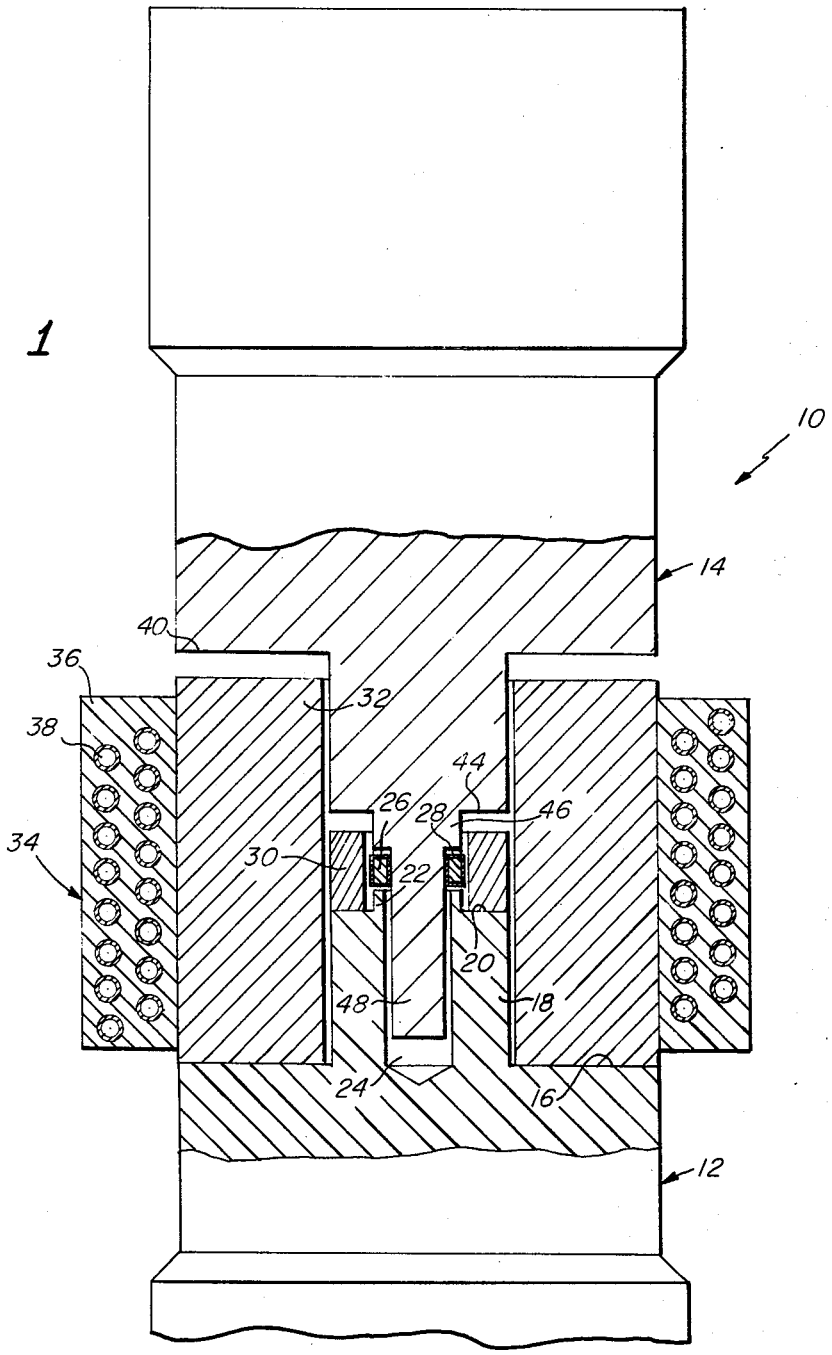
FIG. 1 is an elevational view, partly in section, of a suitable hot pressing apparatus for performing the hot pressing step of this inventive method.
FIG. 2 is a table showing a comparison of respective magnetic values obtained by the hot pressing method and the sintering method.

Samples of isotropic material, axially aligned discs, and radially aligned toroids were hot pressed in a conventional hot press, such as the apparatus 10 shown in FIG. 1, for example. Apparatus 10 includes an axially aligned pair of lower and upper cylindrical punches, 12 and 14, respectively, which are suitably supported for relative longitudinal movement toward and away from one another. The respective punches 12 and 14 preferably are made of a suitable material, such as graphite, for example.

The lower punch 12 is provided with an annular shoulder 16 and a reduced diameter, upper end portion 18 which terminates in an annular shoulder 20 and a smaller diameter, anvil cylinder 22. Centrally disposed in the anvil cylinder 22 may be an open end of a cavity 24 which extends axially in the end portion 16 of lower punch 12.

A samarium-cobalt powder toroid 26 enclosed in a casing 28 of suitable material, such as graphite, for example, may be positioned on the anvil cylinder 22 such that the central aperture of the toroid is aligned with the cavity 24 in end portion 18. Supported on the shoulder of end portion 18 is a sleeve-like die 30 which is made of suitable material, such as graphite, for example. The die 30 encircles the anvil cylinder 22 and extends axially beyond the encased toroid 26 a predetermined distance. Supported on the shoulder 16 of lower punch 12 is a hollow cylindrical die holder 32 which is made of suitable material such as graphite, for example. The die holder 32 encircles end portion 18 and extends axially beyond the die 30 a predetermined distance. Die holder 32 supports an encircling electric heater 34 which may be of the RF induction type or of the resistance type, for examples, comprising a dielectric cylinder 36 having embedded therein a helically wound conductor 38.

The upper punch 14 is provided with an annular shoulder 40 and a reduced diameter, lower end portion 42 which terminates in an annular shoulder 44 and a smaller diameter compressing cylinder 46. The compressing cylinder 46 may be provided with an axially extending center probe 48 which passes through the central aperture of the encased toroid 26, thereby centering it, when the upper and lower punches 12 and 14, respectively, are moved longitudinally toward one another. Thus, the center probe 48 enters cavity 24 and the end portion 42 enters die holder 32 to allow the compressing cylinder 48 to enter die 30 and exert a suitable pressure, such as 1000–10,000 pounds per square inch, for example, on the encased toroid 26. Simultaneously, the electric heater 34 is energized to heat the samarium-cobalt powder material of toroid 26 to a temperature within the range of 800°–1100°C, which is below the sintering temperature range of 1100°–1140°C associated with the samarium-cobalt material. As a result of the specified pressure and temperature, the toroid 26 shrinks substantially only in the axial direction, since it is constrained radially by the confining die 30 and the center probe 48.

The portion of apparatus 10 between the respective shoulders 16 and 40 of lower and upper punches 12 and 14 preferably disposed, by well-known means, within an enclosure (not shown) which may be evacuated or, alternatively, filled with an inert gas, whereby the hot pressing operation may be performed in a controlled atmosphere. Thus, the hot pressing operation may be performed at a suitable vacuum pressure, such as $10^{-4}$ torr, for example, or, alternatively, may be performed in an atmosphere of inert gas, such a helium, for example. Also, it may be seen that when a samarium-cobalt disc is to be hot pressed, the center probe 48 and the axially aligned cavity 24 will not be required. In that instance, a flat end surface of compressing cylinder 46 presses the disc against a similarly flat end surface of anvil cylinder 22 with a pressure between 1000–10,000 pounds per square inch. The disc is heated simultaneously to a temperature within the specified range of 800°–1100°C by the electric heater 34. As a result, the disc shrinks substantially only in the axial direction, since it is constrained radially by the confining die 30.

Samples of isotropic samarium-cobalt powder material, without prior compacting, were hot pressed, as described, into discs which were subsequently magnetized in the axial direction. These hot pressed disc magnets were compared with a sample of compacted isotropic discs which were sintered and annealed, as described, and subsequently magnetized in the axial direction. The results are shown in FIG. 2. The density of the hot pressed isotropic disc magnets, even without prior compacting, was 97 to 98% of the theoretical maximum value, as compared to about 93% for the compacted, sintered, and annealed disc magnets. The magnetic measurements revealed that the hot pressed isotropic disc magnets had a high inductive coercive force ($H_c$) of about 4750 oersteds with a residual induction ($B_r$) of about 5300 gauss for a $(BH)_{max.}$ energy product of $6.5 \times 10^6$ gauss-oersteds. On the other hand, the compacted, sintered, and annealed disc magnets had an inductive coercive force ($H_c$) of about 4400 gauss with a residual induction ($B_r$) of about 4900 for an energy product of about $5.5 \times 10^6$ gauss-oersteds. Also, the hot pressed isotropic disc magnets had an intrinsic coercive force ($H_{ci}$) of about 18,000 oersteds, which was about equal to the intrinsic coercive force of the compacted, sintered, and annealed magnets. Thus, initially, the hot pressed magnets compared favorably with the conventional sintered and annealed samarium-cobalt magnets.

Samples of the compacted isotropic discs were hot pressed, as described, and subsequently magnetized in the axial direction. These compacted and hot pressed isotropic disc magnets were compared with the hot pressed isotropic disc magnets having no prior compacting operation. It was found that the magnetic properties of the compacted and hot pressed isotropic disc magnets were substantially identical to the magnetic properties shown in FIG. 2 for the hot pressed isotropic disc magnets having no prior compacting operation. Thus, it appears that the beneficial effects provided by the compacting operation are achieved in the hot pressing operation without prior compacting. However, the compacting operation also provides means for magnetically aligning the particles of samarium-cobalt powder material at room temperature prior to sintering or hot pressing.

Samples of the compacted, axially aligned discs were hot pressed at about 900°C, as described, and were compared with samples of the compacted, axially aligned discs which were sintered and annealed, as described. Both groups of samples were magnetized in the axial direction by an aligning magnetic field. The second quadrant demagnetization curves for the two samples are shown in FIG. 3 where the curve 52 is representative of the hot pressed, axially aligned disc magnets and the curve 54 is representative of the axially aligned disc magnets which were sintered and annealed. Thus, it may be seen that the hot pressed, axially aligned disc magnets did not have as high a residual induction ($B_r$) or as strong coercive forces ($H_c$ and $H_{ci}$) as the axially aligned disc magnets which were sintered and annealed.

Consequently, an X-ray diffraction study of crystallographic alignment was performed on three types of devices, namely (1) compacted axially aligned discs, (2) compacted and hot pressed axially aligned discs, and (3) compacted axially aligned discs which were sintered and annealed. The resulting inverse pole figures which describe the distribution by crystallographic poles perpendicular to the specimen surface are shown in FIG. **4*a* for the compacted axially aligned discs, in FIG. 4*b* for the compacted axially aligned discs which were sintered and annealed, and in FIG. 4*c* for the compacted and hot pressed axially aligned discs. Thus, a comparison of FIG. 4*a* with FIG. 4*b* discloses that the density of basal poles in the direction of the aligning magnetic field increases during the sintering operation. On the other hand, a similar comparison of FIG. 4*a* with FIG. 4*c*** discloses that the density of basal poles in the direction of the aligning magnetic field does not improve substantially during the hot pressing operation. Consequently, it appears that, during the sintering operation, the resulting grain growth enhances crystallographic alignment, presumably as a result of well-aligned grains growing at the expense of poorly aligned grains, thereby improving the magnetic properties of the sintered and annealed discs.

Figure 5:
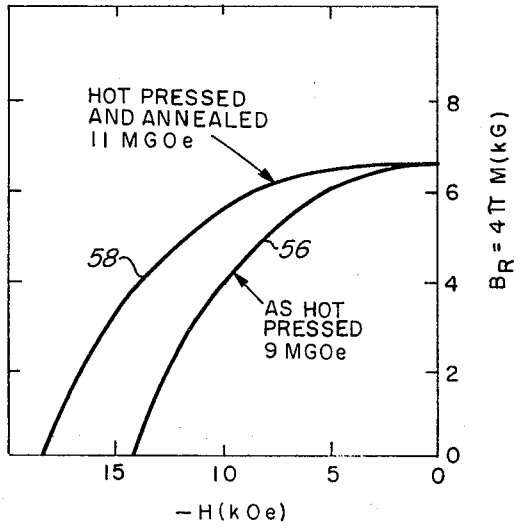
FIG. 5 is a graph showing respective curves obtained from an axially aligned, hot pressed disc before and after annealing.

Accordingly, the demagnetization curves for compacted axially aligned discs were measured after hot pressing at a temperature of 975°C, as described, and then after annealing at a temperature of 900°C. The results ares shown in FIG. 5 where the curve 56 is representative of the sample after hot pressing at 975°C, and the curve 58 is representative of the sample after annealing at 900°C. Thus, it may be seen that the annealing operation does not substantially improve the residual induction ($B_r$) of the sample, but significantly improves the coercive forces ($H_c$ and $H_{ci}$) to values comparable with the sintered and annealed, axially aligned discs.

Two approaches were taken to improve the crystallographic alignment in hot pressed, axially aligned discs. A sample of samarium-cobalt powder material was compacted into discs in a DC generated magnetic aligning field of suitable strength, such as 10,000 oersteds, for example; and second sample thereof was compacted into discs in a DC generated magnetic aligning field which was pulsed to a strength of about 30,000 oersteds. The second quadrant demagnetization curves of two samples are shown in FIG. 6, where the solid line curve 60 is representative of the sample compacted in the DC generated field, and the dashed line curve 62 is representative of the sample compacted in the combined DC and pulsed field. Thus, it may be seen that the effect of pulsing the magnetic aligning field does improve the residual induction ($B_r$) and the coercive forces ($H_c$ and $H_{ci}$), but not to the extent achieved during a sintering operation.

Accordingly, the two samples were heat treated for 2 hours at a temperature of 1140°C. The resulting second quadrant demagnetization curves are shown in FIG. 6 by the solid line curve 64 which is associated with solid line curve 60, and by the dashed line cruve 66 which is associated with the dashed line curve 62. Second quadrant squareness was reduced by the heat treatment, but was recovered by subsequent annealing at 900°C in an atmosphere of inert gas, such as helium, for example. Thus, it may be seen that there is a coresponding improvement in residual induction ($B_r$) for both samples. The residual induction of the sample compacted in the DC aligning field is improved from 6700 gauss before heat treatment to 8100 gauss after heat treatment. Also, the residual induction of samples compacted in the combined DC and pulsed aligning field is improved from 7300 gauss before heat treatment to 8400 gauss after heat treatment. The residual induction values of 8100 gauss and 8400 gauss produced by heat treating the respective samples compare favorably with the residual induction values obtained from sintered and annealed, axially aligned discs, as shown by the curve 54 in FIG. 3.

Inverse pole figures and mean intercept grain size measurements were obtained for hot pressed, axially aligned discs before and after high temperature heat treatment. It was found that the value for mean intercept grain size increased from about 8 micrometers before heat treatment to about 12 micrometers after heat treatment. Also, the density of (0002) poles perpendicular to the surface increased from a value of about 3.7 before heat treatment to a value of about 4.9 after heat treatment. Thus, the increased values of mean grain size, (0002) pole density, and residual induction ($B_r$) indicate the increase in crystallographic alignment taking place with grain growth during the high temperature, heat treatment operation.

Figure 7:
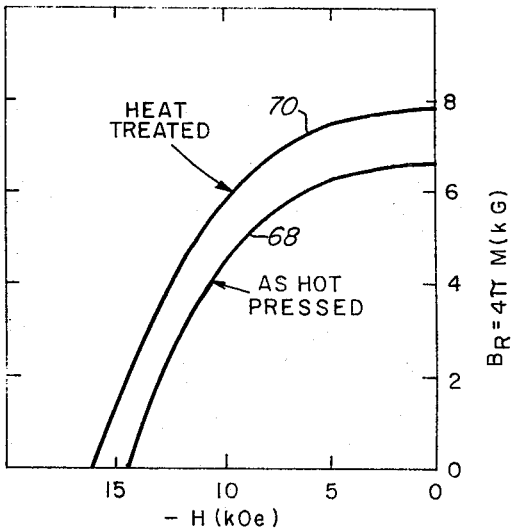
FIG. 7 is a graph showing respective curves obtained from a radially aligned, hot pressed toroid before and after heat treatment.

Accordingly, the compacted radially aligned toroids, previously noted, were hot pressed at a pressure of about 5000 pounds per square inch and a temperature of about 975°C in a suitable vacuum, such as $10^{-4}$ torr, for example. After cooling to room temperature, the toroids were magnetized in the radial direction with respect to the centerline of the toroids as disclosed in the referenced Reid et al. patent application and the demagnetization properties of the toroidal magnets were measured. Then, the toroids were heat treated at a temperature of about 1120°C in an atmosphere of inert gas, such as helium, for example. Subsequently, the temperature was decreased to 900°C and the toroids were annealed for about 2 hours. After cooling to room temperature, the toroids were again magnetized in the radial direction with respect to the centerline of the toroids; and the demagnetization properties of the toroidal magnets were measured. The results are shown in FIG. 7 where the second quadrant curve 68 represents the demagnetization properties of the toroids after hot pressing, and the curve 70 represents the demagnetization properties of the toroids after heat treating and annealing. Thus, it may be seen that the residual induction ($B_r$) and the coercive forces ($H_c$ and $H_{ci}$) of the sample are improved by the heat treating and annealing operation to respective values, such as about 8000 gauss and greater than $15 \times 10^3$ oersteds, respectively, for example, which are comparable to sintered and annealed magnets.

A compacted radially aligned toroid, which had not been hot pressed, heat treated and annealed, was sintered in accordance with conventional sintering techniques for obtaining a pulsing density greater than 93% of the theoretical maximum value. However, during sintering, the toroid cracked into three pieces. This result is consistent generally with prior experience of those skilled in the art when attempting to sinter radially aligned toroids from samarium-cobalt powder material. On the other hand, radially aligned toroids were made from magnetic powder material in accordance with this inventive method, without encountering the radial cracking problems generally associated with sintering. These integral toroids were magnetized in the radial direction to produce radially polarized magnets having magnetic properties comparable to sintered magnetic material, such as a residual induction greater than 8000 gauss, a coercive force greater than $15 \times 10^3$ oersteds, and a maximum energy product greater than $16 \times 10^6$ gauss oersteds, for examples.

Thus, there has been disclosed herein a method fabricating radially aligned toroidal magnets from magnetic powder material in a manner which avoids the radial cracking problems generally encountered when attempting to sinter these magnets. The method may include the steps of mixing elemental components of the magnetic material in a predetermined percentage range and comminuting the resulting composition to a powder which preferably has an average particle size of about 10 microns. The comminuted fine powder material then is radially aligned in a suitable magnetic field and compacted into a toroidal configuration at room temperature and at a suitable pressure, such as fifty tons per square inch, for example. The compacted radially aligned toroid then may be degaussed.

In accordance with this inventive method, the compacted radially aligned toroid is hot pressed at a temperature within 300°C below the sintering temperature range associated with the powder material. Thus, a compacted radially aligned toroid of samarium-cobalt powder material may be hot pressed at a temperature between 800° and 1100°C, for example. As a result, the hot pressed powder material of the toroid shrinks in the axial direction and acquires a density greater than 93% of the theoretical maximum value. The hot pressing step is carried out at a suitable pressure, such as 1000–10,000 pounds per square inch, for example, to achieve the required density in the specified temperature range. Also, the hot pressing step preferably is performed at a suitable vacuum pressure, such as $10^{-4}$ torr, for example, or alternatively in an atmosphere of inert gas, such as helium, for example.

The hot pressed toroid then is heat treated at a temperature in the vicinity of the sintering temperature range associated with the powder material to obtain crystallographic alignment therein similar to the alignment obtained by sintering. Thus, if the toroid is made of samarium-cobalt material, it may be heat treated at temperature between 1100°–1140°C, for example. As a result, the residual induction is increased to a value of about 8000 gauss for example. The heat treating step preferably is performed in an atmosphere of inert gas, such as helum, for example, and preferably is carried out in the same environment as the hot pressing operation, as by simply increasing the temperature to the specified heat treating range, for example.

The hot pressed and heat treated toroid then is annealed at a relatively lower temperature with respect to the heat treating temperature. Thus, is the toroid is made of samarium-cobalt material, the toroid may be annealed at a temperature of about 900°C, for example. As a result, the powder material of the radially aligned toroid is provided with a coercive force, such as greater than $15 \times 10^3$ oersteds, for example, which is comparable to the coercive force achieved when using the sintering method of fabrication. The annealing time interval is adjusted to attain this objective. Also, the annealing operation preferably is carried out in an atmosphere of inert gas, such as helium, for example, and preferably is performed in the same environment as the previous heat treating operation, as by simply decreasing the temperature to within the specified annealing temperature range, for example.

After cooling to room temperature in a controlled manner to maintain the high magnetic properties, the hot pressed, heat treated, and annealed toroid is magnetized in the radial direction with respect to the centerline thereof and substantially parallel with the crystallographic alignment of the powder material. A suitable means for radially magnetizing the toroidal magnet is disclosed in the referenced Reid et al. copending patent application. Thus, the toroidal magnet may be radially magnetized to have a circumferential magnetic pole adjacent the outer periphery thereof, and an opposing circumferential magnetic pole adjacent the inner periphery thereof. This type of radially polarized toroidal magnet has wide applicability as bearings in gyroscopes and as focusing elements in microwave tubes, for examples. Also, the toroidal magnet may be radially polarized to have adjacent its outer periphery a circular array of north and south magnetic poles, each of which is magnetically associated with a respective opposite magnetic pole adjacent its inner periphery. This type of radially polarized toroidal magnet has wide applicability in motors and generators, for examples.

From the foregoing, it may be seen that all of the objectives of this invention have been achieved by the method and apparatus disclosed herein. However, it also will be apparent that various changes may be made by those skilled in the art without departing from the spirit of the invention as expressed in the appended claims. It is to be understood, therefore, that all matter shown and described herein is to be interpreted in an illustrative rather than in a limiting sense.

What is claimed is:

1. A method of fabricating magnets from magnetic powder material comprising the steps of:

hot pressing the powder material into a desired configuration at a temperature in the range of about 800° to about 1100°C, said hot pressing temperature being below the sintering temperature range of the material, and at a pressure in the range of about 1,000 to about 10,000 pounds per square inch, said pressure being sufficient to produce a packing density greater than about 93% of the theoretical maximum value;

heat treating the hot pressed material at a temperature greater than 1100°C, said heat treating temperature being within or higher than the sintering temperature range of the material to produce therein an enhanced crystallographic alignment and a resulting residual induction greater than about 7500 gauss, said residual induction being equivalent to the residual induction achieved by sintering the material;

annealing the heat treated material at a temperature sufficiently lower than the heat treating temperature to provide the material with a magnetic coercive force greater than about $15 \times 10^3$ oersteds, said coercive force being similar to the coercive force obtained by sintering and annealing the material;

cooling the annealed material to room temperature; and magnetizing the material in a preferred direction to produce a magnet having a maximum energy product equivalent to the maximum energy product of a sintered magnet.

2. The method as set forth in claim 1 wherein the magnetic powder material is a composition having a rare earth component and a cobalt component.

3. The method as set forth in claim 2 wherein the rare earth component is samarium.

4. The method as set forth in claim 1 wherein the heat treating step is performed at a temperature between 1100° and 1140°C.

5. A magnet made from magnetic powder material in accordance with a method comprising the steps of:

compacting the powder material into a desired configuration while subjecting it to a particle aligning magnetic field;

hot pressing the compacted and aligned material in a confining die at a temperature in the range of about 800° to about 1100°C and pressure in the range of about 1000 to about 10,000 pounds per square inch, said hot pressing temperature and pressure being sufficient to produce substantially unidimensional shrinkage of the material and a packing density greater than 93% of the theoretical maximum value;

heat treating the hot pressed material at a temperature in the range of about 1100° to about 1140°C, said heat treating temperature being sufficiently higher than the hot pressing temperature to produce an enhanced crystallographic alignement and a resulting residual induction greater than 7500 gauss;

annealing the heat treated material at a temperature sufficiently lower than the heat treating temperature to provide a magnetic coercive force greater than $15 \times 10^3$ oersteds;

cooling the annealed material to room temperature in a sufficiently controlled manner to maintain the specified magnetic properties thereof; and magnetizing the material in a preferred direction to produce an integral magnet having a maximum energy product greater than $16 \times 10^6$ gauss-oersteds.

* * * * *